US009272197B2

(12) United States Patent
Adema

(10) Patent No.: US 9,272,197 B2
(45) Date of Patent: Mar. 1, 2016

(54) SOCCER TRAINING DEVICE, METHOD OF USE AND SYSTEM

(75) Inventor: Wayne P. Adema, Sheboygan, WI (US)

(73) Assignee: PROCONTROL, INC., Sheboygan, WI (US)

( * ) Notice: Subject to any disclaimer, the term of this patent is extended or adjusted under 35 U.S.C. 154(b) by 100 days.

(21) Appl. No.: 13/587,715

(22) Filed: Aug. 16, 2012

(65) Prior Publication Data

US 2013/0344998 A1 Dec. 26, 2013

Related U.S. Application Data

(60) Provisional application No. 61/662,551, filed on Jun. 21, 2012.

(51) Int. Cl.

| | |
|---|---|
| ***A63B 69/00*** | (2006.01) |
| ***A63B 63/00*** | (2006.01) |
| ***A63B 71/02*** | (2006.01) |
| *A63B 71/06* | (2006.01) |

(52) U.S. Cl.

CPC ..... *A63B 69/0097* (2013.01); *A63B 69/002* (2013.01); *A63B 71/02* (2013.01); *A63B 2071/024* (2013.01); *A63B 2071/0694* (2013.01); *A63B 2209/00* (2013.01); *A63B 2210/50* (2013.01)

(58) Field of Classification Search

CPC ..... A63B 69/0097; A63B 63/00; A63B 2225/09; A63B 69/002; A63B 2243/0025

USPC ..... 473/422, 434, 435, 446, 454, 470, 478

See application file for complete search history.

(56) References Cited

U.S. PATENT DOCUMENTS

| | | | | | |
|---|---|---|---|---|---|
| 4,258,924 | A * | 3/1981 | Ketchum | ..... | 473/435 |
| 4,284,277 | A | 8/1981 | Leonard et al. | | |
| 4,588,190 | A * | 5/1986 | Stewart et al. | ..... | 473/435 |
| 4,650,189 | A | 3/1987 | Rajacich | | |
| 5,000,461 | A * | 3/1991 | Borazjani | ..... | 473/476 |
| 5,181,725 | A * | 1/1993 | Leras et al. | ..... | 473/446 |
| 5,290,043 | A * | 3/1994 | Vidinic | ..... | 473/446 |
| 5,524,900 | A * | 6/1996 | Allen | ..... | 273/396 |
| 5,556,104 | A * | 9/1996 | Guillen, Jr. | ..... | 473/435 |
| 5,746,669 | A * | 5/1998 | Sinsheimer et al. | ..... | 473/446 |
| 5,961,403 | A * | 10/1999 | Caruso | ..... | 473/446 |
| 6,209,877 | B1 * | 4/2001 | Warnick | ..... | 273/396 |
| 6,312,348 | B1 * | 11/2001 | Sandell | ..... | 473/415 |
| 6,422,956 | B1 * | 7/2002 | Kusmiss | ..... | 473/435 |
| 6,607,455 | B1 * | 8/2003 | Petras | ..... | 473/478 |
| 6,935,971 | B2 | 8/2005 | Piras | | |

(Continued)

*Primary Examiner* — Mitra Aryanpour
(74) *Attorney, Agent, or Firm* — Boyle Fredrickson, S.C.

(57) ABSTRACT

An invention directed to a soccer training device, method of use and training system. The device is a deflection wall that may be portable. The wall having a larger and smaller embodiment, mimicking the silhouette of a soccer goal or an average player of a given age range from a far distance at simulated closer range. The inventive features of the wall intended to enhance quantity, quality, speed, and accuracy of interaction and perception between the user, the ball and the wall according to professional quality and professional level training techniques. Multiple wall units may be combined to create individualized training modules wherein one person may train in a simulated multi-player environment of varying levels of complexity. Two or more module units may be combined to create a soccer training system. The modules and systems may be staged in limited ground surface area both indoor and outdoor.

9 Claims, 12 Drawing Sheets

(56) References Cited

U.S. PATENT DOCUMENTS

| | | | | |
|---|---|---|---|---|
| 7,001,288 | B2 * | 2/2006 | Harrell | 473/446 |
| 7,249,767 | B1 * | 7/2007 | Gorton | 473/434 |
| 7,462,114 | B2 * | 12/2008 | Moller, Jr. | 473/415 |
| 7,468,009 | B1 * | 12/2008 | Ball | 473/435 |
| D590,030 | S * | 4/2009 | Manderbacka | D21/662 |
| 7,578,757 | B1 * | 8/2009 | McNary | 473/446 |
| 7,909,330 | B2 * | 3/2011 | Domjen | 473/435 |
| 8,113,968 | B2 * | 2/2012 | Fittler | 473/446 |
| 8,480,517 | B2 * | 7/2013 | Guttler | 473/446 |
| D689,570 | S * | 9/2013 | Adema | D21/698 |
| 8,647,221 | B1 * | 2/2014 | Hochberg | 473/446 |
| D704,285 | S * | 5/2014 | Zucca et al. | D21/699 |
| 8,974,325 | B1 * | 3/2015 | Zucca | A63B 69/0097 473/446 |
| 2002/0022540 | A1 * | 2/2002 | Slomski et al. | 473/478 |
| 2003/0013561 | A1 * | 1/2003 | Sompolinsky | 473/435 |
| 2003/0056907 | A1 * | 3/2003 | Caveney et al. | 160/135 |
| 2004/0023735 | A1 * | 2/2004 | Janton | 473/434 |
| 2004/0132558 | A1 * | 7/2004 | Rothman | 473/434 |
| 2004/0176193 | A1 * | 9/2004 | Valliquette | 473/435 |
| 2004/0235589 | A1 * | 11/2004 | Wedgbury | 473/446 |
| 2004/0242349 | A1 * | 12/2004 | Harrell | 473/446 |
| 2004/0266563 | A1 * | 12/2004 | Young | 473/446 |
| 2005/0192125 | A1 * | 9/2005 | Valliquette | 473/446 |
| 2006/0068946 | A1 * | 3/2006 | Harrell et al. | 473/446 |
| 2006/0089213 | A1 * | 4/2006 | Snyder | 473/435 |
| 2006/0237913 | A1 * | 10/2006 | Giske et al. | 473/470 |
| 2007/0167263 | A1 * | 7/2007 | Elder et al. | 473/446 |
| 2008/0032826 | A1 * | 2/2008 | Mubarak et al. | 473/446 |
| 2008/0261727 | A1 * | 10/2008 | Snyder | 473/435 |
| 2009/0069125 | A1 * | 3/2009 | Porter | 473/435 |
| 2009/0139157 | A1 | 6/2009 | Jones | |
| 2009/0176603 | A1 * | 7/2009 | Prince | 473/446 |
| 2009/0197708 | A1 * | 8/2009 | Fuccillo et al. | 473/446 |
| 2011/0015002 | A1 * | 1/2011 | Brown | 473/446 |
| 2012/0329584 | A1 * | 12/2012 | Pinezich et al. | 473/446 |
| 2013/0023362 | A1 * | 1/2013 | Siefker | 473/446 |
| 2013/0102421 | A1 * | 4/2013 | Young et al. | 473/446 |
| 2013/0303312 | A1 * | 11/2013 | DeBolt et al. | 473/446 |
| 2013/0344996 | A1 * | 12/2013 | Adema | A63B 69/0097 473/422 |
| 2013/0344998 | A1 * | 12/2013 | Adema | A63B 69/002 473/446 |
| 2014/0024481 | A1 * | 1/2014 | Adema | A63B 69/0097 473/446 |
| 2015/0190701 | A1 * | 7/2015 | Annapragada | A63B 69/0097 473/435 |

* cited by examiner

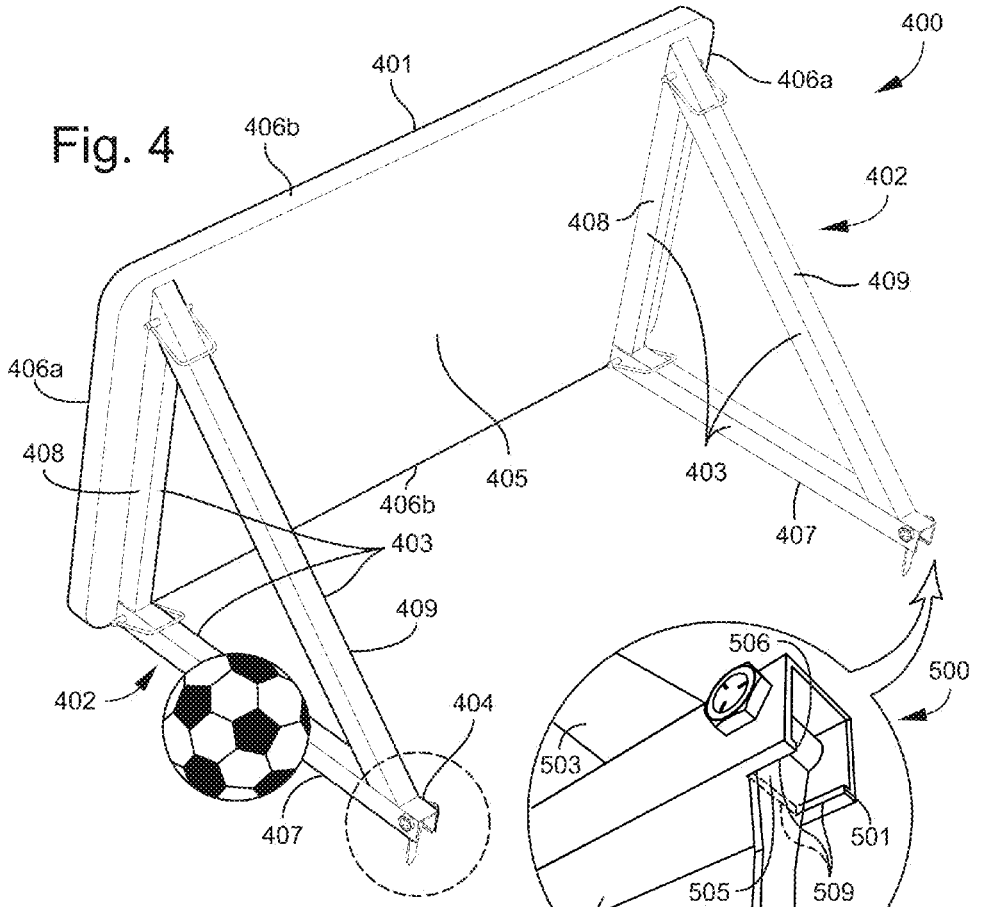
Fig. 4
Fig. 5A
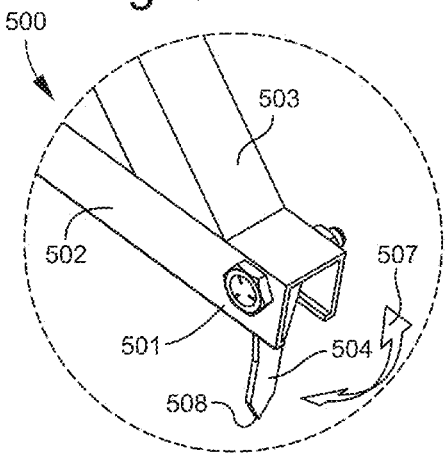
Fig. 5B
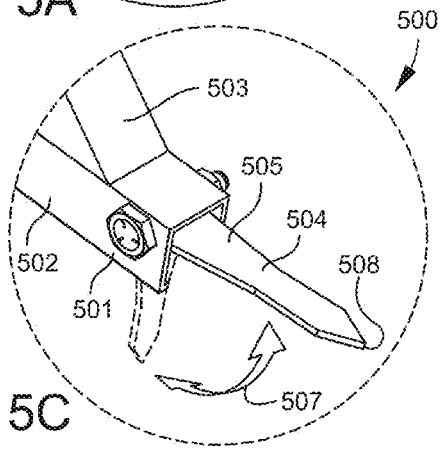
Fig. 5C

SOCCER TRAINING DEVICE, METHOD OF USE AND SYSTEM

CROSS REFERENCE TO RELATED APPLICATIONS

This non-provisional utility patent application incorporates by reference the earlier filed provisional patent application, Application No. 61/662,551, in its entirety. This non-provisional patent application claims benefit of said copending provisional patent application, effectively filed on Jun. 21, 2012, pursuant to 35 U.S.C. 119(e) and 37 C.F.R. 1.78 (a)(4)-(a)(6) and all other relevant sections of the law not referred to herein.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

1. Field of the Invention

The present inventive subject matter relates to a soccer training device, a soccer training system and a method of use.

2. Background

Mastering the game of soccer requires the mastery of one's own body and eye coordination. It is a contact sport where a player's entire body must be intuitively responsive to the ball on the field at any particular time or location. The player's muscles must react reflexively to the field and all things within as though they are extensions of his own body. Professional soccer players spend tremendous amounts of time conditioning their bodies to achieve a level of muscle memory and intuition that makes their movement on the field second nature and fluid. While actual practice is the only way a player can improve his or her skill, the quality and amount of practice determines the rate of actual improvement. In order for any individual to propel themselves to the next level of skill in the game of soccer, they must dedicate sufficient time on the field and off the field to constant muscle training. Soccer being a high contact sport requires equipment and training techniques that simulate a multi-player environment that provides constant dynamic contact.

Mastery of the game requires repetitive training to develop speed and control over the ball and the player's ever changing environment. Improvement of skill requires exposure to new complex variables and the opportunity to practice controlling and overcoming such variables. Variables in the game may be any element in the environment that changes the position of the ball, the player or the team's advantage. Variables may become more complex as more players are involved in a particular game. They may still be complex between fewer players if the skill level of each player enables them to each possess greater control over the ball. It is the aspiration of any soccer player to develop advanced level of skill such that the individual can act and strategize offensively or defensively to capture and maintain control over the ball in any fast paced scenario. To achieve this beyond a team training effort, through individual training, a player must be able to simulate realistic multi-player conditions to create the types of variable challenges encountered on the field during a fast paced game. For a player to develop his or her skills at professional quality level, the player must train and hone his or her skills to the true parameters of the game. High amounts of repetitious training in a simulated dynamic environment will enable any individual player to develop professional level precision, speed and agility that can be translated onto the field in any live match.

The ideal training device and system should be true to the parameters and dimensions of the game. Such parameters include but are not limited to the following: spatial limitations, area of control over the ball within the player's environment, high paced interaction between multiple players, dynamic changing environment from high speed movement of players on the field, intense competition between players to control the soccer ball, spatial spread of players on a field in the course of a game, necessary levels of accuracy in aim for passing and shooting the ball, standard positioning of soccer field components such as the goal posts or other players, quality and types of interaction between the player and different elements on the field (spinning the ball, passing the ball between players, etc.), material composition of equipment (rubber soles of shoes and the ball), visual effects from the field environment and components within (white or metallic soccer goals, green sod for outdoor soccer field, tan wooded floors of indoor soccer arena), etc. The ideal training device and system would manage and control the scope of variables so that the user can recreate and repeat training, or scale the variables down to focus on specific sets of variables. The device and system would evolve with the user by enabling the user to introduce new challenges or variables at various stages of improvement. All the while, such a device should remain useful and relevant to users of all skill level. The ideal device should enable an individual user to achieve high amounts of repetitious contact with the ball, achieve high speed multidirectional movement and tight ball control, train to the true parameters of the game, and develop multiple skills in tandem as would be expected from a multi-player training environment.

Current products in the market that offer individualized repetitive training fail to reflect real parameters and challenges experienced on the field specific to the sport of soccer. These products are easily outgrown due to their limited usefulness relative to the long term needs of aspiring soccer players. The following summarizes current soccer rebound devices designed primarily for kick training. Their deficiencies and limitations are inherent in their designs, offering limited practical use to serious trainers. U.S. Pat. No. 5,556,104 provides a training device with multiple functions on multiple sides. The problem is that each functional side interferes with the usefulness of the other feature during training. Further, the device is not constructed in a manner that when positioned on the ground with the board surface side facing forward, would maintain stability against frequent high impact contact with a soccer ball.

U.S. Pat. No. 4,650,189 is a rebound net assembly intended for softball or baseball pitch training. Not only are there too many parts to this device making it difficult to transport, but the net feature is not ideal for soccer training purposes since it cannot replicate a deflection similar in feel and quality to that of a professional soccer player. Further, the surrounding frame protrudes from the overall wall surface, creating interaction with the ball that is not otherwise experienced in reality. The device also lacks a self-stabilizing component that allows it to withstand the full impact of repeated impact of a high speed soccer ball.

U.S. Patent Application No. 2005012125A1 provides a device with multiple paneled sides that requires assembly to be functional. The design of this device prevents it from being staked or anchored to the ground for added stability. The weight of water or sand filling its cavity is insufficient to stabilize the device against frequent high impact of a soccer ball by serious trainers. Further, the size and shape of the device does not reflect the natural coverage of an opposing player's silhouette. Thus accuracy and precision of the player would be disproportionately skewed to the disproportionate size of the device over time and use.

The device of U.S. Patent Application No. 20020022540 A1 takes up a great amount of space on the field with its multi-panel construction. This device is very one dimensional in that, despite the multi-panels involved and the ability to have multiple users train at once, players are restricted to using one panel at a time and cannot train interactively with other players.

U.S. Pat. No. 7,909,330 comprises a hollow base requiring filler, such as water or sand, to create stabilizing weight. As stated before, the design is inconvenient and unstable for the quality and amount of ball to wall impact sought to be achieved by serious trainers.

U.S. Pat. No. 6,935,971 provides another rebound panel made of netting. A great deal of assembly is required and the device is not easily transportable. As with other netted devices, the frame surrounding the four sides of the device interferes with the ball's trajectory path and the interaction of the ball with the rebound surface.

U.S. Pat. No. 4,284,277 describes a kick ball game and apparatus kit that may be used indoor or outdoor, played similarly to soccer or hockey but does not require special skills from the players. This patent provides for an interesting method of arranging players of the game with predefined rules of operation. This patent is not intended as a soccer training method or apparatus and does not function as such.

A considerable need remains for inventive solutions that improve upon the quality of soccer training devices, methods and systems. All patents and applications referred herein are incorporated by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

SUMMARY OF THE INVENTION

The invention herein achieves a quality and type of professional grade training never seen before for individualized soccer training. The award winning professional level skill and experience of the inventor as both a lifetime soccer athlete and coach has enabled the inventor to gain the proper insight to develop a device and system that offers these combined training features in an elegant and effective way. The goal of this invention is to enable an individual user to achieve high amounts of repetitious foot training, practice high speed multi-directional movement while maintaining tight control over a soccer ball, develop accurate aim, perception and intuition for the true parameters of the game, and eventually learn to strategize and control both the ball and the player's unpredictable environment. These goals are achieved by the unique design and training method described as follows.

The invention herein makes optimal use of material and design by improving on the following features: choice of material composition of the device to enhance realistic simulated interaction between the ball and user, effective use of exposed surfaces on the device to maximize interaction, ergonomic design to avoid unwanted secondary interactions (e.g., no protruding attachments from the wall such as nuts and bolts to avoid unnatural deflection of the ball from the wall, no extra framing, etc.), dimensional considerations so as to simulate true distance and size parameters between the players on a field, compressed dimensional features to encourage high speed proximate interaction, choice of color to condition the user's depth and peripheral perception, minimization of secondary distractions not natural to the game (such as loose rattling or reverberation), simulation of multi-player environment by modularizing the device which encourages high speed multidirectional interaction and control, consideration of distance between devices within a given module specifically to train passing techniques according to best practice for professional quality soccer training, adjustability of modules to control complexity and allow for personalized training.

The device described herein is a soccer deflection wall. Each wall is comprised of one or more panel and a supporting unit. Each said panel may be embodied in the shape of either a square or rectangle but is not limited to these described shape embodiments. The panels having rounded exposed corners to minimize wear and tear on a deflecting ball and to mimic the interaction of a ball against the curve of a player's foot. The word exposed hereinafter will mean any surface that is open and unobstructed from the general field environment such that said surface may have direct contact with a traversing ball approaching or deflecting from said surface. All exposed surfaces of the device that may serve to deflect the soccer ball should be completely even without protrusion, introverted contours, recesses, cracks or crevices, holes, extensions, etc. Protrusions from exposed surfaces such as bolts and frame attachments or crevices and cavities could cause unnatural deflection of the ball and risk expensive damage to the impacting ball. The dimension of the wall (vertical length and horizontal width) should simulate the proportional perspective of a far distant silhouette of a player of a given age range or goal post from close proximity. The device may be scaled up or down to the relative size of the user to achieve the intended purpose. For example, infant children approximately three years of age may require smaller versions of the device to achieve the same goals achievable by this invention. The reason for this preferred size dimension is to encourage accuracy of aim and perception within a compressed environment but to the true dimensions of opposing players at a distance on the field.

Each panel should have an exposed main surface, a back surface and side edge surfaces. The surfaces are substantially smooth with no attachments or cavities on the exposed portions. The main surface should have a perimeter border that is preferably white or metalic in color, the total combined surface area of the perimeter border comprising less than fifty percent of the surface area of said exposed main surface. The remaining interior portion should have a color similar to a standard soccer field or arena. The typical color of a standard outdoor soccer field is green for sod grass, typically beige for indoor wooded floor panels and occasionally green for painted indoor soccer arenas. The reason for this color combination and pattern is to train the user's sense of perception and intuition to the standard effects of the game.

The exterior panel surface is comprised of a semi-viscous and semi-flexible material similar to rubber, latex or neoprene to create a dampening and gripping effect that is consistent in wet and dry conditions. The slight gripping effect or viscosity of the rubber like substance on the surface of the panel enables the user to manipulate the ball against the panel to create unique deflection and aim that may be recreated between multiple live players. The gripping effect is similar in texture and durability to a typical soccer player's shoes. The interior material composition of each panel would preferably be comprised primarily of wood, wood composite (or stiff organic fiber material such as bamboo) for its hardness and unique low reverberation effect. Reverberating sound from a surface upon impact can be a distracting element leading to unwanted sensory conditioning. Alternative solid material may be used interchangeably and should be sufficiently dense to enhance the quality of deflection from the panel surface while having minimal reverberation upon impact. The slight dampening effect particularly achieved by wood fiber material will also help limit wear and tear on the ball from extended use. Composition of the wall panel may include any of the following material and is not limited to metal, wood, foam, plastic, combinations of these materials or any future unknown material that achieves the described intended quality and purpose.

The wall is embodied in two sizes, a larger and a smaller size. The smaller size embodiment is intended to train passing skills and will be referred to as a passing wall. The larger size embodiment is intended to train shooting techniques and will be referred to as a shooting wall. A passing wall scaled to the size of an average adult player in ready position (standing with legs spread apart) would preferably have a height that is between two to three feet and a width that is approximately three and a half feet to four and a half feet. The size of the shooting wall may range between three to four feet in height and approximately six to eight feet in width, proportional to a long distance perspective of a standard goal post from within ten yard of the player. The dimensions however may be proportionally smaller in alternative embodiments to accommodate the average dimensions of very young players.

The deflection panel is connected to a support assembly for purposes of stabilizing the panel on the ground and maintaining the device in an erect vertical position during use. The support assembly may be detachable and portable or permanently affixed to the device and the ground by an anchor. Material composition of the support assembly may comprise of and is not limited to weather resistant metal, organic or inorganic fiber material or plastic.

An anchored support assembly would be connected to the panel and further connected to an anchor that is embedded beneath the field surface. The piece that connects the panel to the anchor may be detachable such that the position for the panel would be permanently fixed but the panels themselves may be removed to avoid theft or weather. When in use, the separate components of the anchor support and panel connect together to create a tight rigid immovable connection. The sturdiness and rigidity should have no secondary affect (i.e. rattling, budging movement, etc.) upon rapid frequent high impact on the panels.

A portable support assembly provides for a panel that is connected to a support unit, the support unit further connected to a portable fixturing means (i.e. spike, stake, pad, suction, pin, etc.) such that the device would not be permanently positioned in any location but may be moved and positioned anywhere feasible. Material composition of the support and fixturing means may include any of the following durable and weather resistant material such as galvanized metal, organic or inorganic fiber, plastic, etc. A preferred embodiment of the fixturing means comprising a ring or hinge connected to a flat stake (preferably triangular and flat in shape) which swivels around the axis of an axle. The axle may be a detachable rod separately connected to the ring or it may be a portion of the ring itself. The axle (essentially a thin rod) is a means for keeping the stake attached to the support to minimize spare parts. The rotating or swivel feature of the axle and stake allows the stake to swivel into position for anchoring while remaining connected to the fixture unit. The continual connection between the axle and the stake allows the fixture to remain unitarily connected to the device as it is being used and in between use during transport. The swivel feature further allows the stake to flip away from the ground surface should the device be dragged along the ground during transport, minimizing damage to the field. The fixturing means may be removable from the support assembly such that when removed, the device may be staged or stationed within an indoor arena. When in use, fixturing means would be attached to the support assembly and the stake would be inserted into the ground. The stake would rotate or flip downward towards the solid support. Upon abutting the solid support, the stake is prevented from further movement. The abutment will occur and remain in place after the stake has penetrated into the ground surface. This stabilizes the panel and holds the entire device in rigid form against forceful frequent impact from the ball. No secondary affects (rattling, budging, etc.) should result from this manner of fixture.

Multiple units of two or more may be erected and staged oppositely in modularized fashion. The opposing distance between any two passing walls should be approximately ten yards or less for purposes of simulating true spatial parameters of the game in a compressed environment. Any distance beyond ten yards will begin to take on qualities of shooting and becomes less practical for training passing skills The adjacent distance between the side edges of neighboring passing walls should be no less than two yards to mimic the standard minimum spread between players in the game. These distance parameters follows best practice in the industry for training professional soccer skills but have been adjusted to accommodate individual training in a compressed environment. The manipulated dimensions of the module and device is engineered and designed to react to the individual user and create a simulated effect of high speed competitive interaction between players from close proximity. Additional walls may be positioned at an angle from the parallel rows of each module. Each added device will increase complexity by introducing new variables.

Multiple modules may be staged adjacent to each other to create a personalized soccer training system. Players are able to control amount of complexity by adjusting the devices within a particular module. As the user masters a particular set of challenges within a given module, the newly acquired skills are further put to the challenge in a new environment. Progressive and controlled training through this type of modular system allows the user to become intimately familiar with otherwise unpredictable variables. This helps develop intuition in movement, speed, aim and accuracy. Mastering these basic skills allow the user to begin developing strategic control techniques. The results of which allow the user to remove some element of unpredictability from the game.

A complete modular training system may be erected within forty square yards or less, maximizing use of space and having a very small foot print on any field or arena. Portability of the device allows anyone to design a personalized modular training system and quickly position it in any location. The shape of the device further allows for manufacturability by extrusion method.

The training device, method of use and modular training system provided herein does not exist in the art at this time. Current products within the market lack the embodiment and capability to encourage the type of professional skill development that is achievable with this invention. Other features, advantages, and object of the present invention will become more apparent and be more readily understood from the following detailed description, which should be read in conjunction with the accompanying drawings.

BRIEF DESCRIPTION OF THE DRAWINGS

The present invention is illustrated by way of example, and not by way of limitation, in the figures of the accompanying drawings and in which like reference numerals refer to similar elements. Unless otherwise indicated illustrations in the figures are not necessarily drawn to scale.

FIG. 4 A three dimensional view from the back of an alternative embodiment of the device comprising one panel and bracket support assembly, the device not drawn to exact scale or perspective.

FIG. 5A, 5B, 5C A three dimensional exploded view of the fixturing means of the support mechanism of the invention described herein, the device not drawn to exact scale or perspective.

DETAILED DESCRIPTION OF THE PREFERRED EMBODIMENTS

Reference will now be made in detail to exemplary aspects of the present invention which are illustrated in the accompanying drawings. Wherever possible, the same reference numbers will be used throughout the drawings to refer to the same or like parts.

Figure 1A:
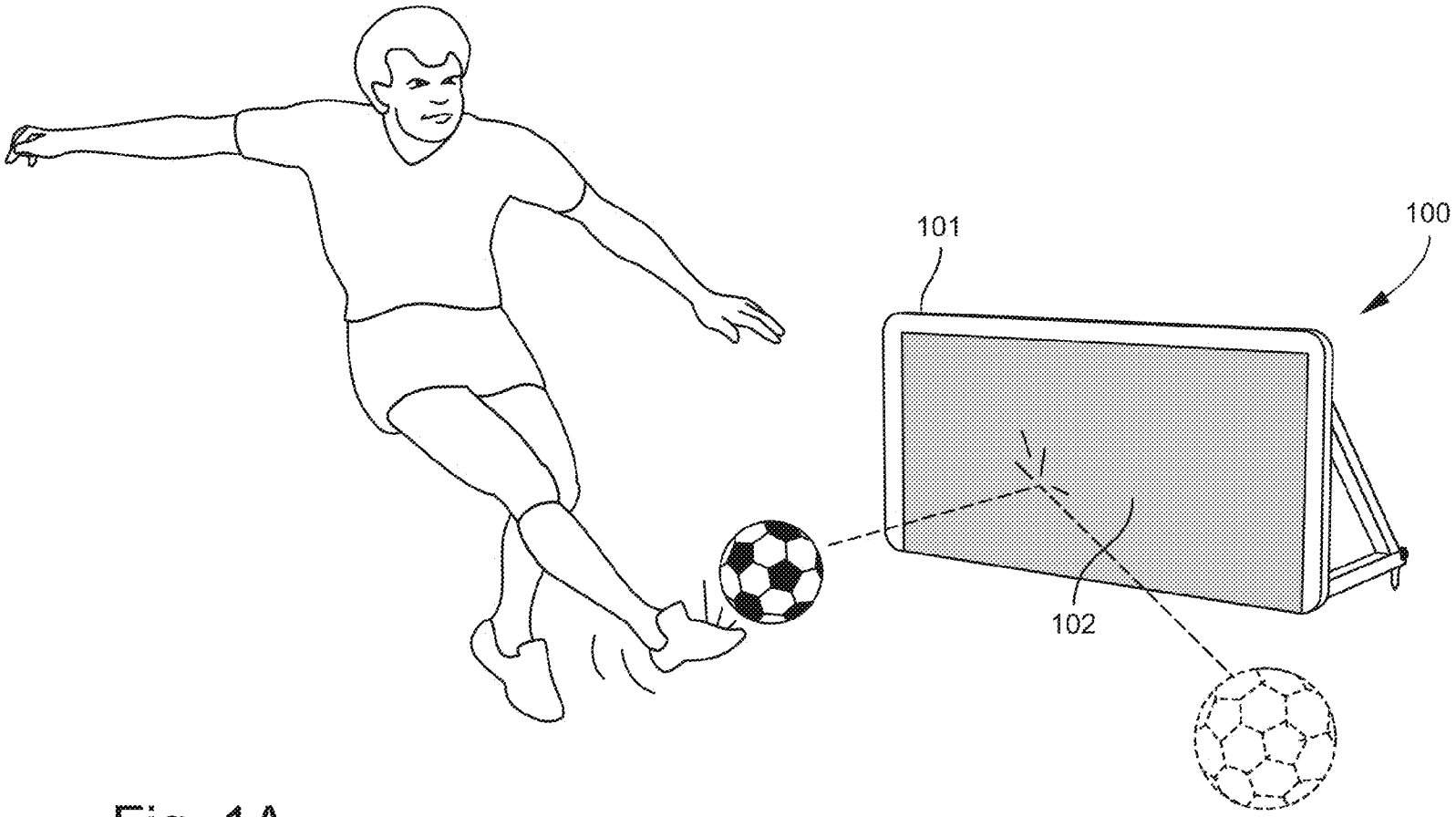
FIG. 1A A front view of a panel of the device according to one embodiment of the invention described herein, the device not drawn to exact scale or perspective.

FIGS. 1A and 1B provide a general embodiment of the device, a deflection wall. The device in FIG. 1A and 1B is not drawn to scale and represents a generic illustrated description of the claimed features. FIG. 1A is a front view of the device, a deflection wall 100 comprising one panel 101 and having a preferred rectangular shape. FIG. 1A illustrates an exposed front surface 102 of the panel. The front surface 102 being flat and smooth, containing no attachments or cavities that would interfere with the interaction with the ball. FIG. 1B illustrates a side view of the panel, having an exposed front surface 102 with greater surface area than the exposed side surface of the surrounding edge 103*a, b*. The corners 104 of the panel would preferably be soft and curved such that deflection of a ball from said corner would closely simulate a ball being kicked from the curve of a person's padded shoe as opposed to a hard jagged surface. The curved or rounded corners 104 further minimize wear and tear on a ball typically experienced with sharp or jagged edges.

As stated above, the device may be embodied in two preferred sizes. A larger size according to FIG. 2B defined as a shooting wall 200, and a smaller size according to FIG. 2A defined as a passing wall 201. The shooting wall having a dimension proportional in perspective to a standard soccer goal post frame from a far distance; preferably between three to four feet high 202 and approximately six to eight feet wide 203. The passing wall would preferably be approximately two to three feet high 204 and three and a half feet to four and a half feet wide 205, simulating the silhouette of an average adult soccer player standing in ready position with legs spread apart. The two sizes may be scaled down to the proportional dimensions of average users of a particular age range such as shorter youth players or smaller infant-children players. The panel is placed on its widest side surface 103*a* directly on and perpendicular to the ground during use. The panel surface is comprised of a thick, semi-flexible and semi-viscous material similar to rubber or neoprene. The panel surface may be textured to enhance grip over the ball but should not have substantial grooves, cavities or raised features otherwise interfering with simulated ball interaction. The interior of the panel, substantially comprised of any solid material such as but not limited to wood, plastic, glass, metal, foam, carbon fiber or any combination each. The interior composition of the preferred embodiment would be comprised of wood or wood composite material.

Figure 2:
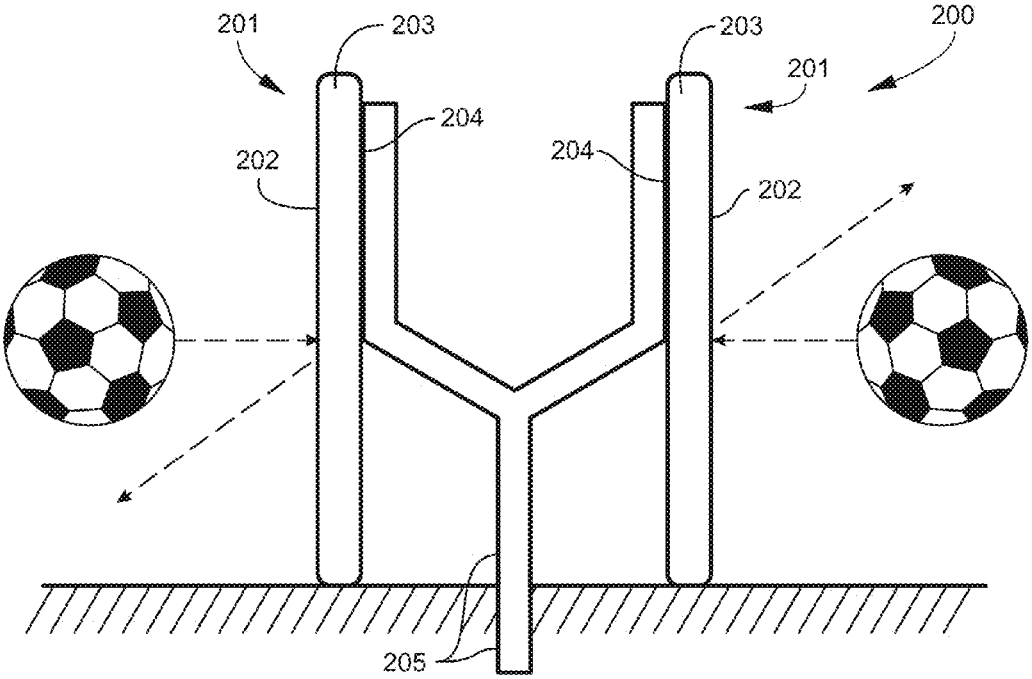
FIG. 2 A side view of a panel of the device comprising two panels and a support according to one embodiment of the invention described herein, the device not drawn to exact scale or perspective.

FIG. 2 illustrates an alternative embodiment of the deflection wall 200 having two panels 201. Each panel according to this side view illustration having one exposed front or main surface 202, a substantially exposed side edge surface 203 (all but the bottom which is in contact with the ground) and an obstructed back surface 204 (facing a central stabilizing unit and the second panel). This alternative embodiment is fully usable from both sides 202 of the device. As stated above, the device may have one or more panels 201, each panel having one or more exposed surface 202. Therefore, the device may have a multiplicity of panels 201 or exposed surfaces 202. FIG. 2 illustrates the device relying on an anchor support assembly 205 (generally illustrated in the drawings).

Figure 3:
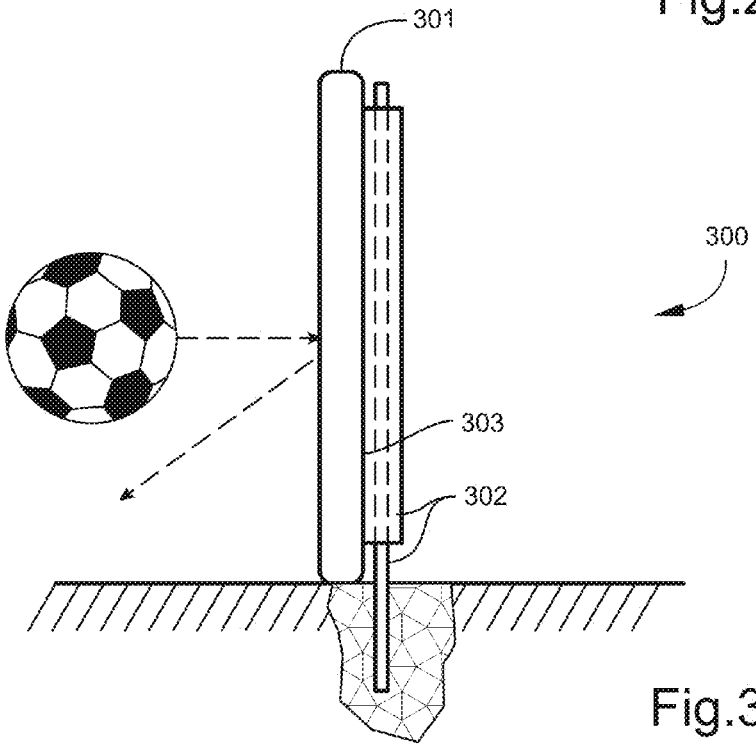
FIG. 3 A side view of an alternative embodiment of the device described herein, the device not drawn to exact scale or perspective.

FIG. 3 illustrates an alternative embodiment of the device 300 having one panel 301 attached to an anchor 302 support assembly (generally illustrated in the drawings). FIG. 3 illustrates a side view of this embodiment of the device demonstrating the support 302 connected to the back surface 303 of the panel 301, the support detachably connected to an anchor portion below the ground surface (not shown) such that the panel 301 is stabilized in an erect position above ground and ready for use. One or more support or support components 302 may be connected to a particular panel 301. The need for more would depend on the size and composition of the panel design or the ground surface composition. The embodiment of FIG. 3 illustrates one of many potential manner of construction known in the art and should not be read in a limiting fashion.

FIGS. 4, 5A and 5B illustrates another embodiment of the device 400 having one panel 401 attached to a support assembly 402. FIG. 4 illustrates a side view of this embodiment of the device in which the support comprises two angled brackets 403 each bracket connected to a fixturing means 404. The angled bracket 403 may comprise any hard weather resistant material such as but not limited to stainless or galvanized steel, durable plastic, carbon fiber or any combination of such material. The bracket may be adjustable folding towards the panel's back surface in the collapsed position for ease of transport or be detachable from the panel piece as a separate component for transport. The support assembly 402 is not limited to an angled bracket means 403 but may include any similar manner of structural and stabilizing support of the panel 401 in a vertical upright position over a soccer field or arena.

Preferably the supporting assembly 402 would be attached to the panel 401 without holes or protrusion through any exposed surfaces of said panel 401, such as but not limited to nails and screws. Further, the connection between parts of the device 400 in whole and upon fixture to the ground surface for intended use should be substantially sturdy and having minimal movement or noise, particular upon forceful impact. Unwanted sounds or deflection interaction arising from the wall upon impact may negatively affect psychological aspects of training, resulting in secondary unwanted habits or else simply interfering with the overall focus of training. The choice of material, composition and design of attachment features, many of which are already known in the art, can be chosen to minimize this unwanted effect.

Figure 6A:
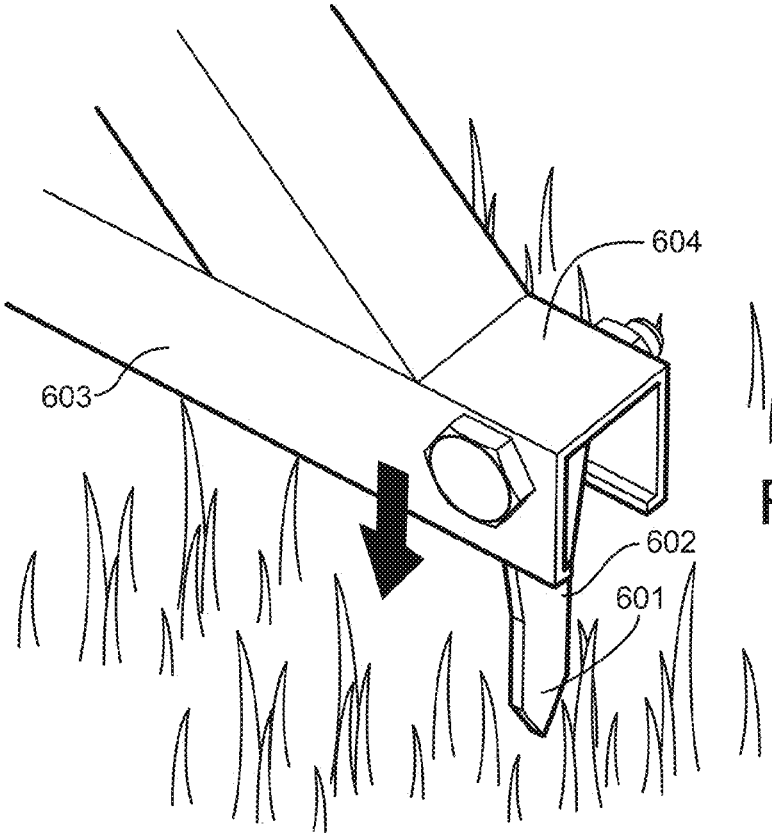
FIG. 6A, 6B A three dimensional exploded side view of the fixturing means of the support mechanism of the invention described herein, the device not drawn to exact scale or perspective.
Figure 6B:
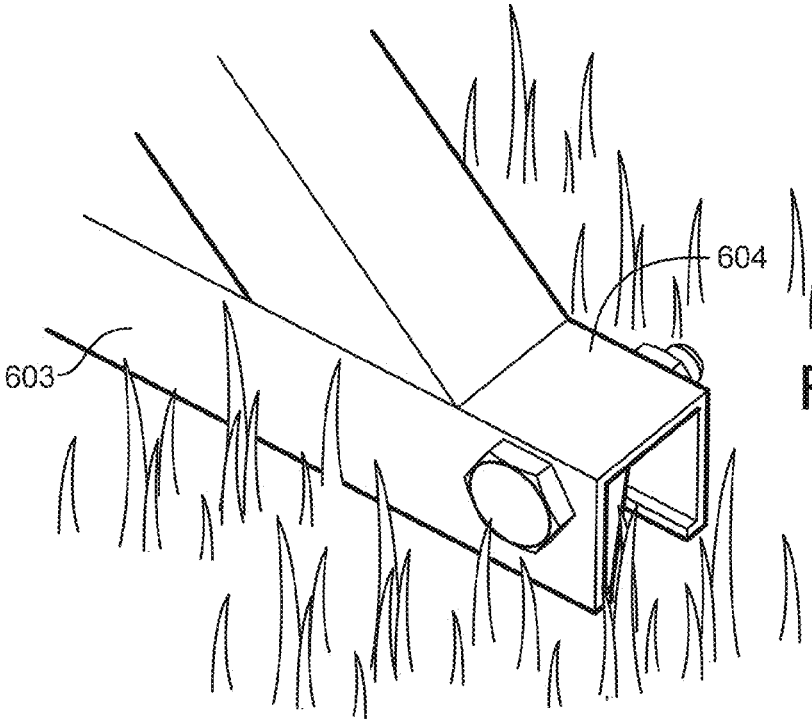
Figure 6C:
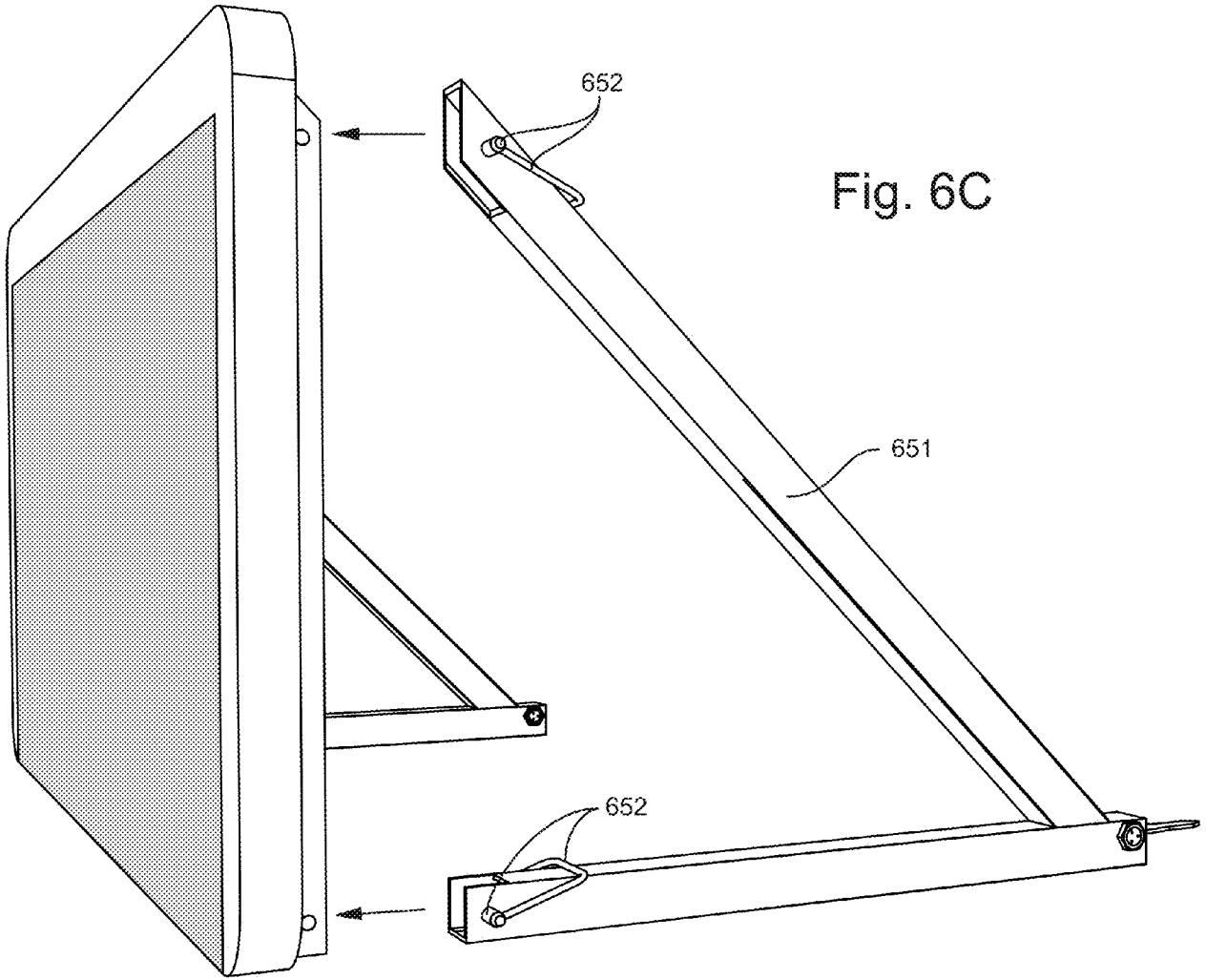
FIG. 6C A three dimensional side view of one embodiment of the invention according the description herein, the device not drawn to exact scale or perspective.

FIG. 4 illustrates the back side 405 view of an embodiment having two triangular brackets 403 attached to the back surface 405 of a panel 401. Each angled bracket 403 recessed approximately seven to ten inches inward from the edges 406*a* of the panel sides so as to minimize obstruction to a soccer ball trajectory path. The angled bracket 403 having a horizontal piece 407 resting above the ground surface and extends perpendicularly from the bottom edge 406*b* of the back surface 405 in a vertical direction. The horizontal piece 407 and a vertical piece 408 are connected by a tangential piece 409. The connection between the back wall surface 405, the horizontal piece 407 and the tangential piece 409 creating a triangular shape as illustrated in the drawings. The horizontal 407 and tangential 409 pieces preferably comprised of weather resistant metal. FIG. 6C further illustrates a portable detachable version of the angled support brackets 651 wherein the brackets 651 may be attachable and detachable by a spring lock or clip mechanism 652.

A fixturing means 500 according to FIGS. 5A, 5B and 5C is connected to the joint end 501 where the horizontal piece 502 and tangential piece 503 meets. An exploded view of the fixturing means 500 as illustrated in FIGS. 5A, 5B and 5C comprising a flat triangular wedge 504 whose wider end 505 contains a hollowed sleeve or tubular portion 506 (shown in part) within whereby a link or thin axle rod (or any equivalent thereof) (not shown) is slid through said sleeve such that the wider side of the wedge swivels around the link or rod 507. The fixturing means 500 is connected to the horizontal piece 502 at the joint end 501 such that it may swivel around the axis of the horizontal piece. When in use according to FIGS. 6A and 6B, the pointed end 601 of the flat wedge 602 is positioned downward perpendicular to the ground surface and perpendicular to the cross section of the horizontal piece 603 at the joint end 604. The wedge is then driven into the ground with the flat side buttressing or abutting a blunt end (see FIG. 5A, 509) of the horizontal piece 603. The abutment of the flat wedge 504 against the blunt end 509 of the horizontal piece 502, as illustrated in FIG. 5A, prevents the wedge from rotating further along the axle rod thus stabilizing the device against forceful impact.

Figure 7A:
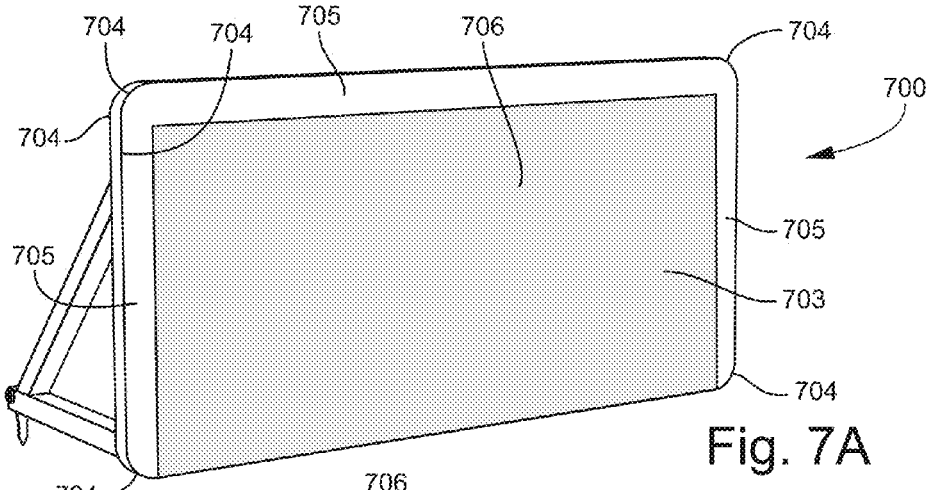
FIG. 7A A front view of the device in a generic embodiment according the description herein, the illustration is not drawn to exact scale or perspective.
Figure 7B:
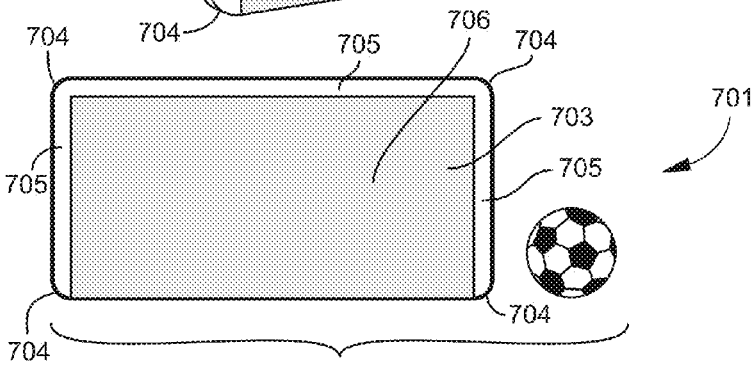
FIG. 7B A side view of a preferred embodiment of the device according the description herein, the illustration is not drawn to exact scale or perspective.
Figure 7C:
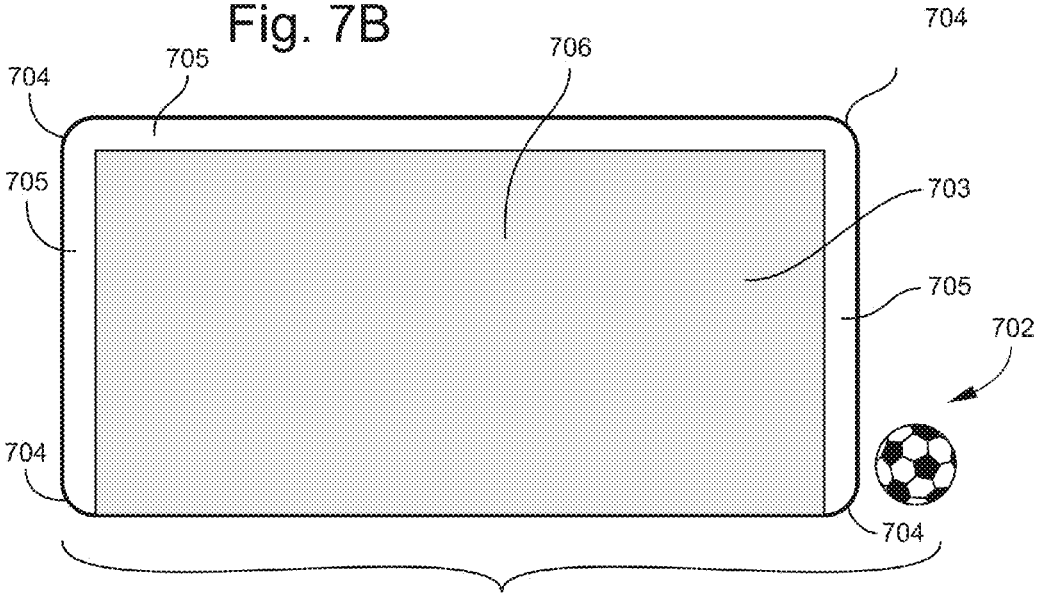
FIG. 7C A side view of a preferred embodiment of the device according the description herein, the illustration is not drawn to exact scale or perspective.

FIGS. 7A, 7B and 7C illustrating the exposed front or main surface 703 of a preferred embodiment of the device 700, 701, 702. FIGS. 7B and 7C illustrating a larger 702 and smaller 701 sized version of the panel device 700. The devices are not drawn to exact scale but are drawn to relative scale as intended for an adult user and a standard goal post. The exposed front panel 703 having soft rounded or curved corners 704, a white colored border 705 comprising less than fifty percent of the surface area of the exposed main surface 703, the central area or portion 706 of the exposed main surface within the perimeter of the white border 705 having a color mimicking a real soccer field or arena such as tan, beige, brown or green.

Figure 8A:
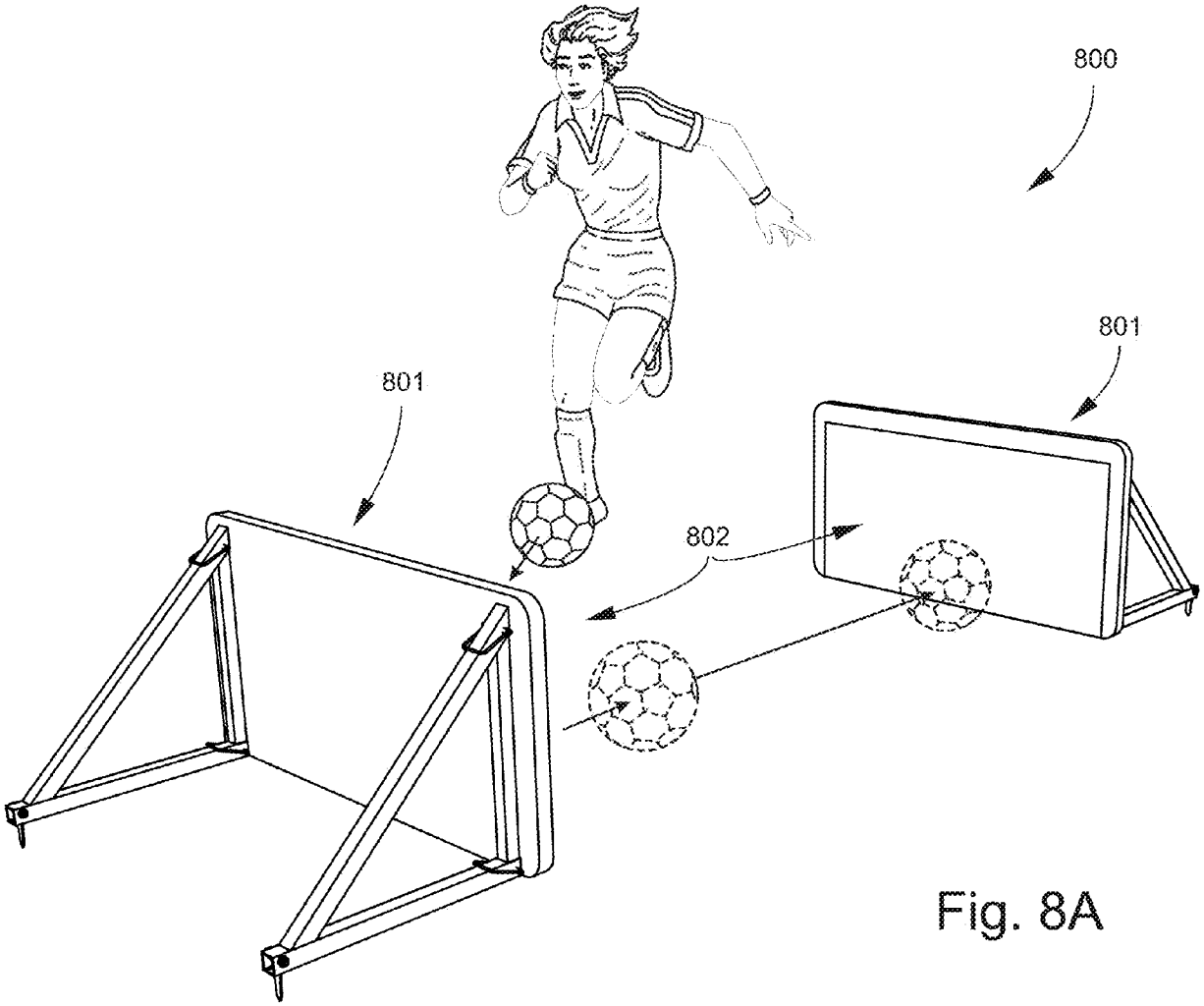
FIG. 8A A three dimensional perspective view of a module according to the description herein, the illustration is not drawn to exact scale or perspective.
Figure 8B:
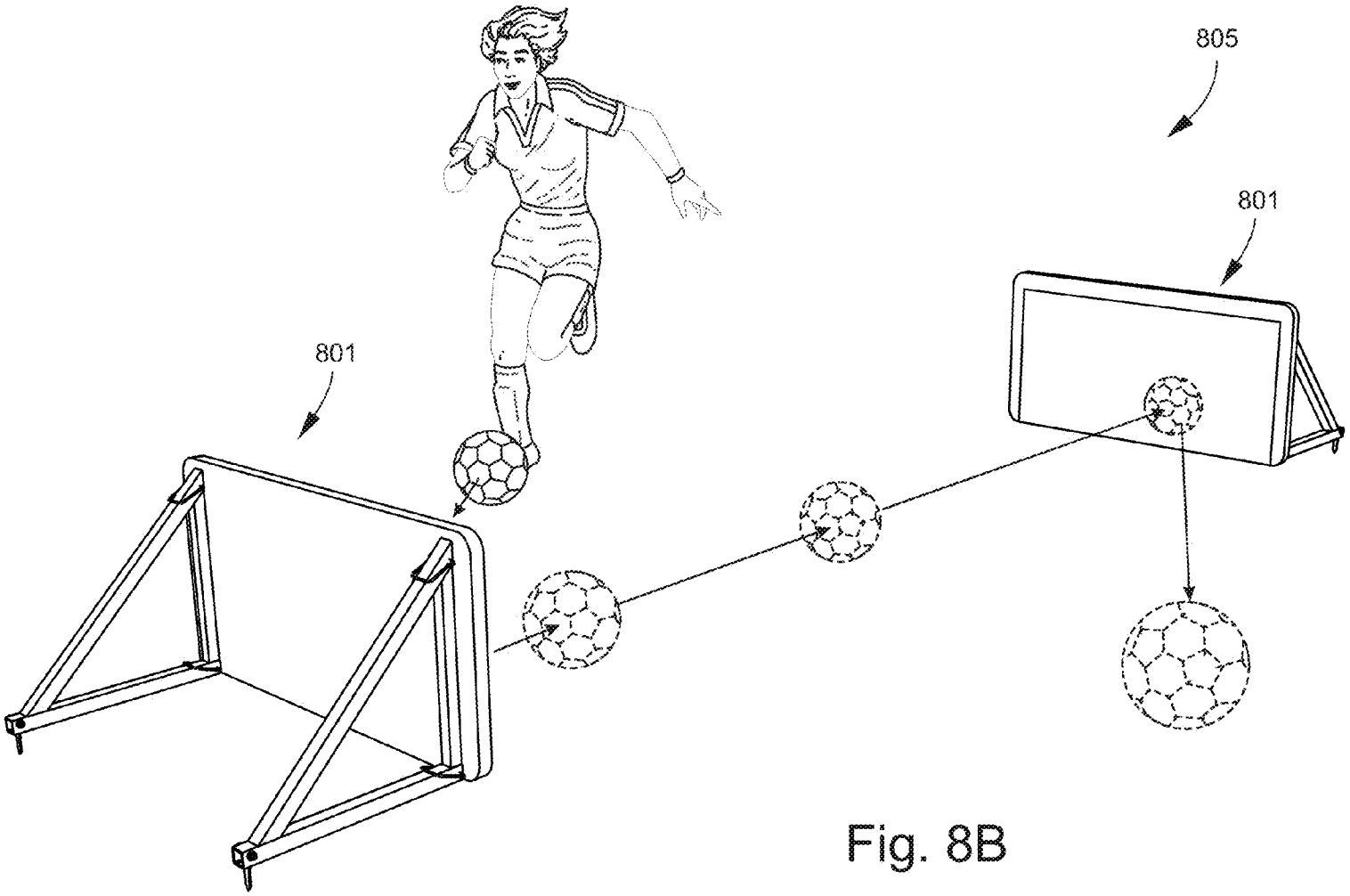
FIG. 8B A three dimensional perspective view of a module according to the description herein, the illustration is not drawn to exact scale or perspective.

FIG. 8A illustrates a soccer training module 800 comprising two smaller passing walls 801 wherein each respective exposed main or front surface 802 is positioned directly opposite from each other. FIG. 8B illustrates an alternative embodiment of a two passing wall 801 module 805 that is spaced further apart. Variations in the distance between passing walls will vary but should be ten yards distance or less as a rule for purposes of mimicking actual distance between players within close practical passing range according to standard practice in the game of soccer. This range of distance further facilitating and encourage rapid, high repetition passing interaction between the player and the passing walls. FIGS. 8A and 8B are not drawn to scale or perspective.

Figure 9:
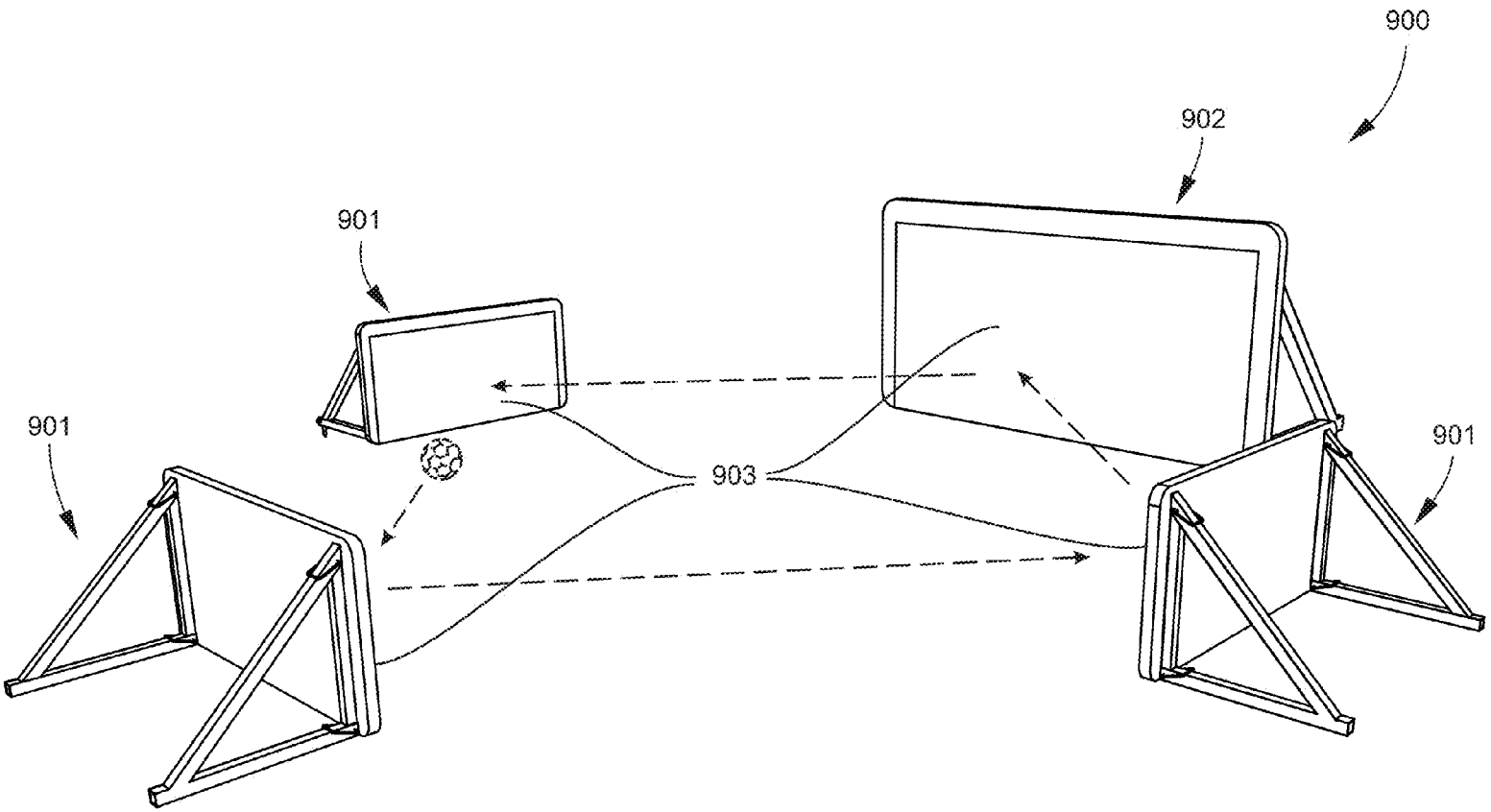
FIG. 9 A three dimensional perspective view of a module according to the description herein, the illustration is not drawn to exact scale or perspective.

FIG. 9 illustrates a more complex soccer training module 900 having three passing walls 901 and one shooting wall 902, whose exposed main surfaces 903 are centrally facing wherein the combination of panels are oriented to create a rectangular or square pattern. This configuration and other module configurations may be embodied in permanent attachments to the ground surface by way of an anchor support assembly or system. FIG. 9 is not drawn to scale or perspective either.

Figure 10:
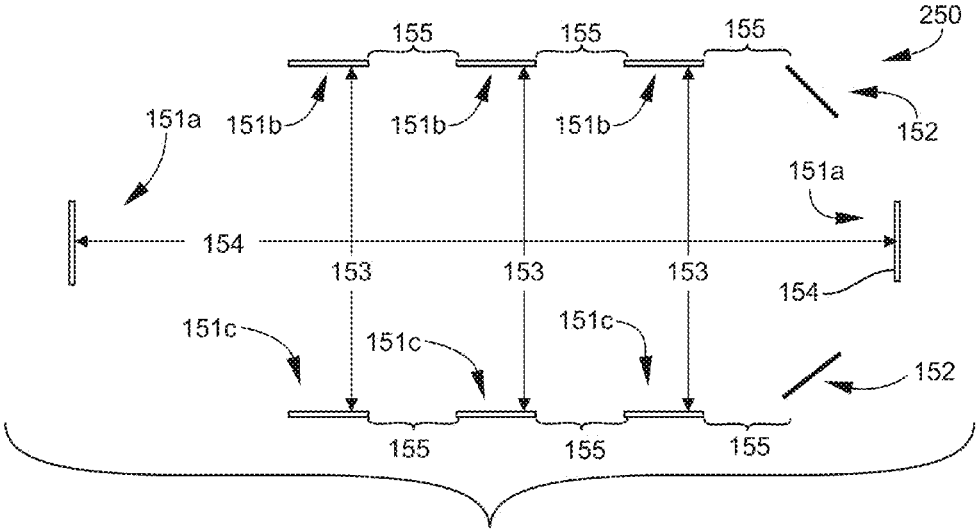
FIG. 10 A top plan view of a module according to the description herein, the illustration is not drawn to exact scale or perspective.
Figure 11:
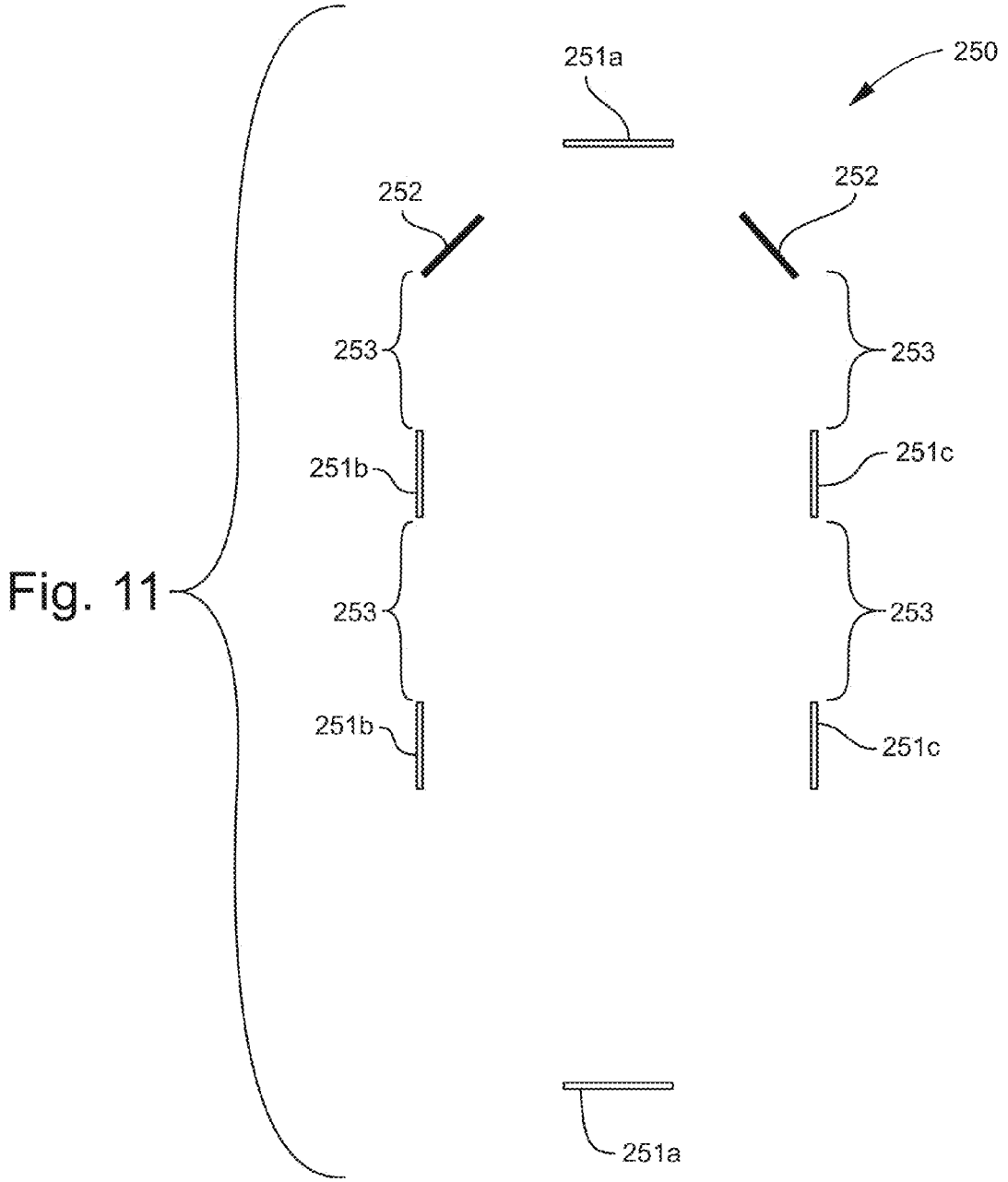
FIG. 11 A top plan view of a module according to the description herein, the illustration is not drawn to exact scale or perspective.

FIG. 10 illustrates an even more complex embodiment of a soccer training module 150 having eight permanently positioned devices 151*a, b, c* with two additional portable devices 152 in angled positions. This embodiment of the module having three pairs of passing walls 151*b, c* and one pair of shooting walls 151*a*, simulating a complete multiplayer game environment. The three pairs of passing walls 151*b, c* are positioned opposite to each other in parallel form, with two rows of three passing walls 151*b, c*. The pair of shooting walls 151*a* is positioned opposite each other between the two rows of passing walls 151*b, c* and at each ends of the two rows. The eight walls 151*a,b,c* forming a rectangular shaped module 150. The distance between the exposed main surfaces of the two rows of passing walls 151*a,b,c* (along the length of the rectangle between exterior surfaces of the two opposing walls) is approximately eight yards. The distance between the exposed main surface 154 of the opposing shooting walls 151*a* is approximately 32 yards. The distance between adjacent passing walls within a given row (from side edge 155 to side edge 155) is approximately two yards or greater. FIG. 11 illustrates an alternative embodiment of a complete field module 250 with six permanently fixed devices 251*a,b,c* and two portable devices 252 in an angled position. The distance between side edges 253 of the passing walls within the same row 250*a,c* remains at least two yards of separation at a minimum, mimicking the natural minimum spread between players in actual play according to standard practice and training of the game.

Figure 12:
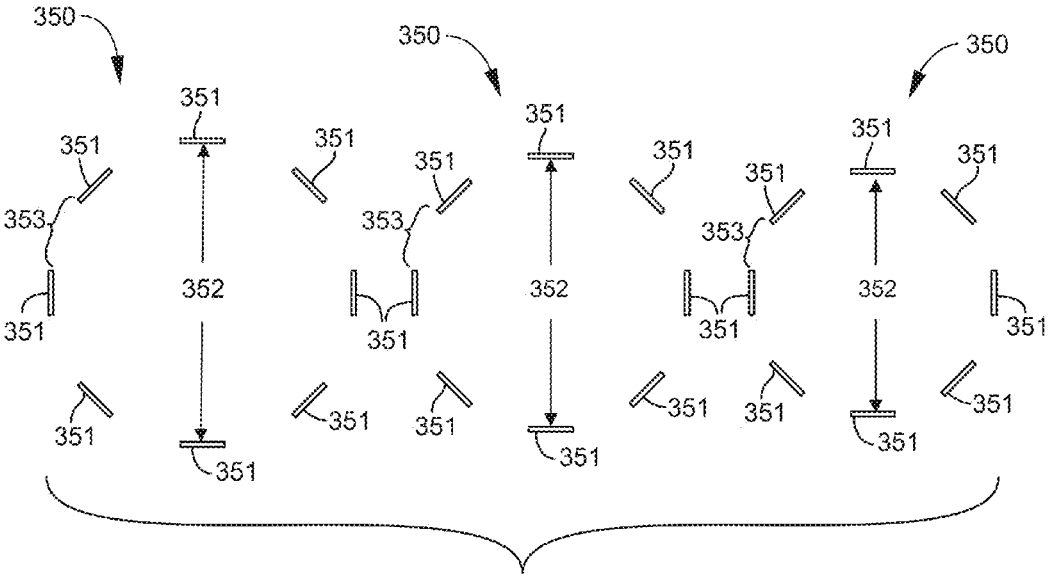
FIG. 12 A top plan view of a module according to the description herein, the illustration is not drawn to exact scale or perspective.

FIG. 12 illustrates three circular modules 350, each module containing eight passing walls 351, the exposed front surface of each passing wall 352 centrally facing the same central radial point to form a substantially circular or oval pattern. The distance between side edges 353 of the passing walls remains at least two yards of separation at a minimum, mimicking the minimum natural spread between players in actual play according to standard practice and training of the game.

Figure 13:
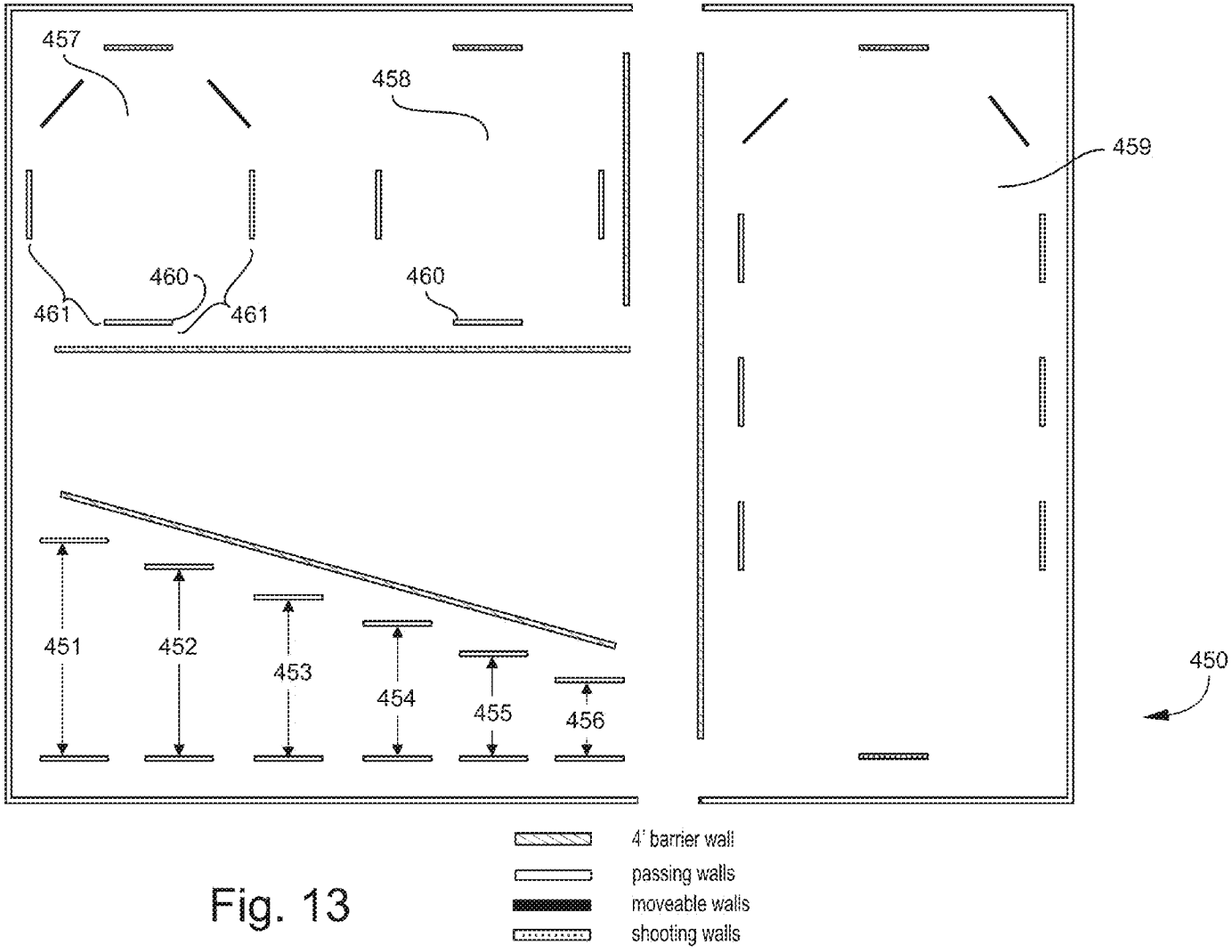
FIG. 13 A top plan view of a complete modular training system according to the description herein, the illustration is not drawn to exact scale or perspective.

FIG. 13 illustrating one embodiment of a complete soccer training system 450 having nine sets of modules (451, 452, 453, 454, 455, 456, 457, 458, 459 of progressive levels of complexity. The first six sets of modules (451, 452, 453, 454, 455, 456) representing the least complex types, each containing two passing walls. The distance between the exposed front surface of the opposing passing walls within each of the first six modules are as follows: Module 1 (451)=10 yard; Module 2 (452)=9; Module 3 (453)=8; Module 4 (454)=7; Module 5 (455)=6; Module 6 (456)=5. These distances reflect the closest range of separation between players in passing position in actual play according to standard practice and training within the game of soccer. Any distance further than 10 yard would require shooting of the ball and detract from training passing techniques.

Modules 6 (457) and 8 (458) of FIG. 13 represents the next progressing levels of modular complexity. These two sets each contain four permanent devices with three passing walls and one shooting wall. Both module units contain three passing walls and one shooting wall. The dimensional requirements of Module 7 & 8 are as follows: two passing walls in opposing position with the respective exposed surfaces separated by approximately seven yards distance; one passing wall perpendicularly positioned 460 between the two passing walls at approximately two yards distance between side edges 461; a shooting wall perpendicularly positioned relative to the two opposing shooting walls on the opposite end from the perpendicular passing wall 460; the shooting wall separated from the perpendicularly positioned passing wall 461 at approximately 14.13 yards distance. Portable devices or walls may be added to existing permanent modules to increase complexity of training.

The last module 9 (459) of this system 450, is substantially similar to the complete field module described in FIG. 10 or 11. Alternative modular embodiments, such as the type described in FIG. 12, may be added or substituted for any of the modules described within FIG. 13. The described training system and modules described above may be reconfigured to add extra levels of complexity by adding more devices at desired position on an existing modular environment. Alternative embodiments of the system may comprise less numbers of module units or fewer training levels. The described training system and module units may be permanently affixed onto a dedicated field or may be transported and movable anywhere along a field. The claimed device may be manufactured with either manner of construction in mind.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

What is claimed is:

1. A soccer training device comprising:

a) one or more rigid panels, the one or more rigid panels having a width, a height and a thickness, the one or more rigid panels further including exposed side edges, and an exposed planar surface, wherein the planar surface of the one or more rigid panels includes a layer of semi-viscous and a layer of semi-flexible material which gives a dampening and gripping effect to the planar surface; and b) a support structure detachably connected to the one or more rigid panels such that when the one or more rigid panels is in an erect position, the exposed planar surface of the one or more rigid panel is held upright in a substantially vertical position over the ground surface and the lineal vector direction of the height of the one or more rigid panels is bisecting the horizontal plane of the ground surface, wherein the support structure includes a ground-engaging member pivotally connected to the support structure and movable between a use and a non-use position, the ground-engaging member including a sleeve through which a rod is positioned, and wherein the rod is rotatably secured to the support structure.

2. The device of claim 1 wherein the one or more rigid panels further including two or more deflection panels positioned or staged in a predetermined orientation relative to each other.

3. The device of claim 2 wherein the two or more deflection panels are comprised of a small panel, a large panel or a combination thereof.

4. The device of claim 1, wherein the ground-engaging member has a ground-engaging wedge opposite the sleeve.

5. The device of claim 4, wherein the wedge is triangular in shape.

6. The device of claim 1, wherein the support structure includes a stop with the ground-engaging member, limiting movement of the ground-engaging member with respect to the support structure.

7. The device of claim 6, wherein the stop is formed as a portion of the support structure.

8. The device of claim 7, wherein the stop is formed as a blunt end of the support structure.

9. The device of claim 1, wherein the ground-engaging member is at least partially retained within the support structure in the non-use position.

* * * * *